United States Patent [19]

Brunosson

[11] 4,449,431

[45] May 22, 1984

[54] SCREW WRENCH

[75] Inventor: Bengt B. Brunosson, Enköping, Sweden

[73] Assignee: AB Bahco Verktyg, Enköping, Sweden

[21] Appl. No.: 343,312

[22] Filed: Jan. 27, 1982

[30] Foreign Application Priority Data

Feb. 20, 1981 [SE] Sweden ..... 8101151

[51] Int. Cl.[3] ..... B25B 13/16

[52] U.S. Cl. ..... 81/165; 81/130 R; 81/170

[58] Field of Search ..... 81/110, 128–130 R, 81/134, 147–151, 153, 155, 165–167, 170, 172, 175, 176, DIG. 2, 53 R, 407, 414, 416

[56] References Cited

U.S. PATENT DOCUMENTS 759,869 5/1904 Ellis .
1,245,581 11/1917 Gniewcrynski .
1,376,721 5/1921 Mueller .
2,653,501 9/1953 Hunter .

FOREIGN PATENT DOCUMENTS 45919 6/1932 Denmark .

*Primary Examiner*—Frederick R. Schmidt
*Assistant Examiner*—Debra S. Meislin
*Attorney, Agent, or Firm*—Banner, Birch, McKie & Beckett

[57] ABSTRACT

An adjustable wrench has a fixed jaw at its head. A movable jaw is adapted on a slide glidably accommodated in the wrench head, the slide being positionable in optional positions by means of an adjusting screw or other device. The slide has a web in the form of a substantially planar plate running in a slot in the wrench head. A slide rod is in engagement with grooves in the side walls of the slot. The web has an elongate opening and the slide rod constitutes a separate rod, which is inserted in the elongate opening such that it has lateral play.

5 Claims, 9 Drawing Figures

SCREW WRENCH

BACKGROUND OF THE INVENTION

The invention relates to an adjustable spanner or screw wrench with a fixed jaw at the wrench head and a movable jaw, arranged on a slide glidably accommodated in the wrench head, said slide being adjustable in optional positions, by means of an adjusting screw or other means, and has a plate-like web running in a slot in the wrench head, there being a rod-shaped body in engagement with grooves in the side walls of the slide slot for retaining the slide in the slot.

In conventional screw wrenches, the rod-shaped body consists of a swelling on the slide web along its rack-toothed edge facing towards the adjusting screw. This conventional construction of the slide with an integral web and rod-shaped body, or slide rod, requires very great manufacturing accuracy to afford a good fit between the slide and its slot in the wrench head. In spite of tight tolerances, several different dimensions may interact unfavourably to spoil the fit.

SUMMARY OF THE INVENTION

The object of the invention is to propose a solution simplifying the production of screw wrenches, by reducing the number of dimensions which have a bearing on the fit between the slide and the wrench head.

The intended result is obtained by making the rod-shaped body a separate body which is inserted in an elongate opening in the slide web, the elongate opening having its longitudinal axis in the direction of travel of the slide. There is play between the opening and the rod, allowing the rod to move laterally in the slide web.

Two embodiments of the invention are described in detail in the following with reference to the appended drawings.

DESCRIPTION OF THE PREFERRED EMBODIMENTS

Figure 1:
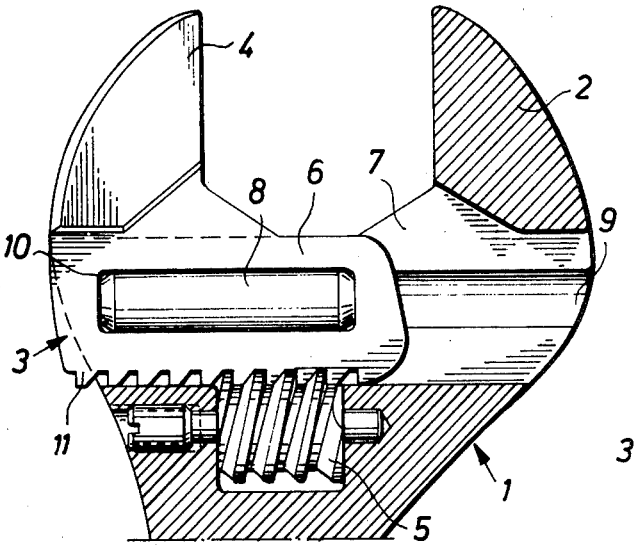
FIG. 1 is a section in the plane of symmetry through a screw wrench head.
Figure 2:
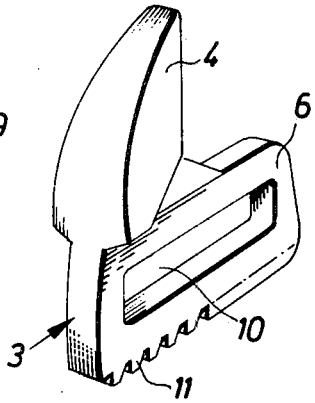
FIG. 2 is a perspective view of a slide in accordance with the invention, corresponding to the slide as seen in FIG. 1.
Figure 3:
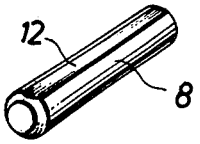
FIG. 3 is a perspective view of an embodiment of a slide rod in accordance with the invention.
Figure 4:
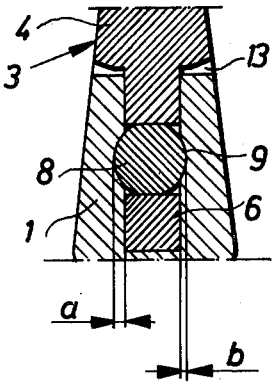
FIG. 4 is a principle sketch in the form of a partial section through the wrench head and slide, transverse the slide rod.

At its head 1, the screw wrench is provided with a fixed jaw 2, and a slide 3, glidably accommodated in the head. The slide is formed with a jaw 4 which thus is movable in relation to the fixed jaw 2 and according to how it is adjusted, as determined by an adjusting screw 5. The slide has a web 6 in the form of a substantially planar plate which is thinner than the jaw 4 and runs in a slot 7 in the wrench head, this slot being disposed about the plane of symmetry of the wrench. The slide 3 is glidably retained in the slide slot 7 by a slide rod 8, which is thicker than the web 6 and has each of its side portions projecting from the web in engagement with a groove 9 in the respective side surface in the slot 7.

More specifically, the slide 3 is manufactured with a flat-ground web 6 and without a rod-like portion. Instead, there is a substantially rectangular opening 10 in the web for a slide rod 8, which is formed as a separate body. The longitudinal axis of the opening 10 is oriented in the travel direction of the slide and in register with the axis of the grooves 9, when the web edge provided with teeth 11 is in mesh with adjusting screw 5.

According to FIGS. 3, 4, 5 and 8, the slide rod 8 is a cylindrical pin suitably having two diametrically opposing ground planes or flats 12 (only one of which is shown in FIG, 3, the other being hidden from view, but both of which can be clearly seen in FIG. 5) for providing the desired fit in the opening 10. FIGS. 6 and 9 illustrate another embodiment of the slide rod 8', and in this case the rod has a substantially quadratic cross section. The grooves 9 in the side surface of the slide slot 7 have in both cases a cross-sectional configuration adapted for accommodating the slide rod. The grooves according to FIG. 5 and 8 thus have a cross section which is arcuate while those according to FIGS. 6 and 9 have a substantially flat bottom with straight sides perpendicular thereto.

Figure 6:
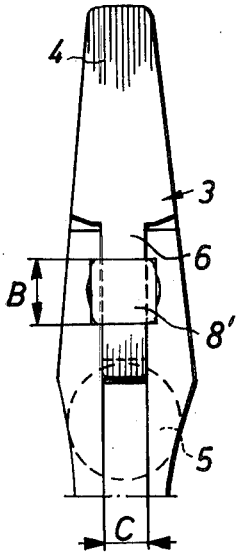
FIG. 6 is an end view similar to FIG. 5 but relating to another embodiment.
Figure 7:
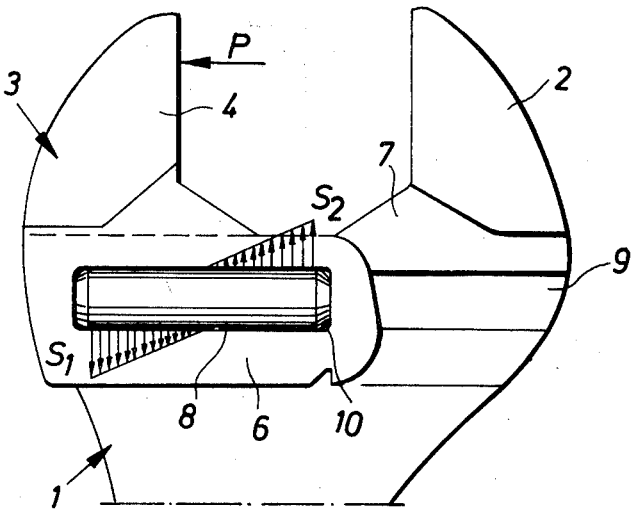
FIG. 7 is a principle sketch corresponding to FIG. 1, illustrating the forces acting on the wrench head via the slide rod.
Figure 8:
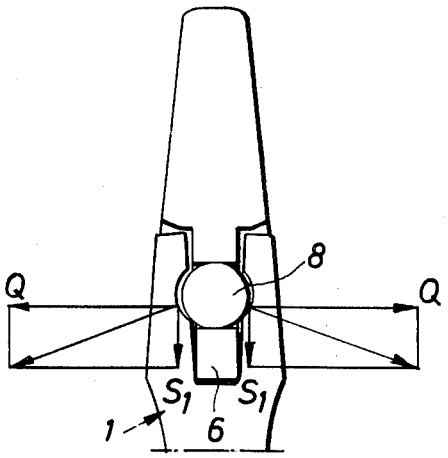
FIGS. 8 and 9 are sketches indicating how the forces between the slide rod and wrench head are taken up in the embodiments according to FIGS. 5 and 6.
Figure 9:
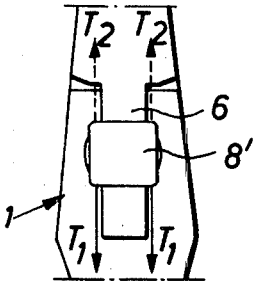

It will be seen from FIGS. 7 and 8 that when the slide is loaded with the force P, it gives rise to forces between the slide rod 8 and the side walls of the slot 7 in the wrench head, and these forces have an outwardly directed component Q striving to expand the slot, simultaneously as other components $S_1$ and $S_2$ (with different directions at the ends of the slide rod) are directed against the handle of the wrench and against the jaw opening of the wrench, respectively, in planes parallel to the main plane of the wrench, thus giving rise to forces of reaction from the body material of the head 1, so that these reaction forces (opposed to the forces $S_1$ and $S_2$) will take up the torque caused by the force P. With the embodiment according to FIGS. 6 and 9, there is thus eliminated the outwardly directed components, since no skewed inclined contact surfaces occur between the slide rod and the sides of the grooves. Instead, the forces $T_1$ and $T_2$, indicated in FIG. 9, counteract the force P, and act in planes parallel to the plane of symmetry of the wrench. The embodiment according to FIGS. 6 and 9 is to be preferred from this point of view.

However, independent of the slide rod 8, the slide web 6, caters for the lateral fit between the slide 3 and head 1 in both embodiments. Furthermore the slide rod caters by itself for the guidance and fit of the slide in height. Accordingly, the centre of the passage formed by the grooves 9 for the slide rod 8 in the wrench head do not need to laterally coincide with the centre of the slot 7 itself. Possible manufacturing faults in this respect are compensated by the laterally (a, b) "floating" slide rod. Furthermore, this solution permits space 13 between the wrench head and the underside of the jaw 4 as will be seen from FIG. 4.

Figure 5:
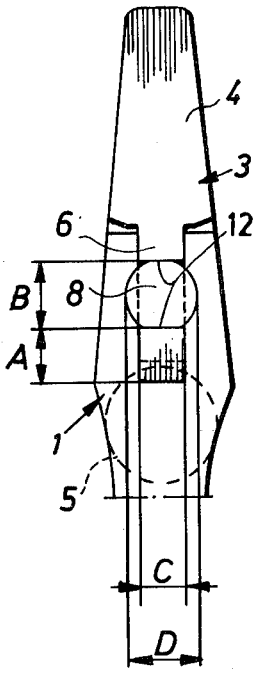
FIG. 5 is an end view of the wrench head in an embodiment corresponding to what is illustrated in FIGS. 2 and 3.

The dimensions of coacting parts which need to be kept with great accuracy are denoted A, B, C and D in the embodiment according to FIG. 5. In the embodiment according to FIG. 6, the number of such dimensions has been reduced to those denoted by B and C.

I claim:

1. An adjustable spanner or screw wrench including a head having a fixed jaw, which is arranged on a slide glidably accommodated in the wrench head, said slide being adjustable in optional position by means of an adjusting means, the slide having a web in the form of a substantially planar plate running in a slot in the wrench head, there being a rod in engagement with grooves in the side walls of the slot for retaining the slide in the slot, characterized in that the rod constitutes a separate body, which is inserted in an elongate opening in the slide web, said opening having its longitudinal axis in the direction of travel of the slide and substantially parallel to the longitudinal axis of said rod, there being play between the opening and the rod, allowing the rod to move laterally in the slide web, said rod being longitudinally movable together with said slide.

2. Wrench as claimed in claim 1, characterized in that the rod by itself, due to its fit in the grooves in the side walls of the slide slot, guides the slide in the depth direction of the slot, while space is left between the wrench head and the underside of the movable jaw.

3. Wrench as claimed in claims 1 or 2, characterized in that the rod is substantially cylindrical and that the grooves in the side walls of the slot are substantially arcuate in cross section.

4. Wrench as claimed in claim 3, characterized in that the shape of the rod deviates from cylindrical shape by having two diametrically opposing flats with a spacing between them corresponding to the height of the elongate opening.

5. Wrench as claimed in claim 1 or 2, characterized in that the rod has a generally rectangular, preferably substantially quadratic cross section and that the grooves in the side walls of the slide slot have substantially flat bottoms parallel to said side walls and straight sides substantially perpendicular to said bottom.

* * * * *